US005762383A

United States Patent [19]

Gomi

[11] Patent Number: 5,762,383

[45] Date of Patent: Jun. 9, 1998

[54] CHILD PROOF APPARATUS FOR VEHICLE DOOR LATCH DEVICE

[75] Inventor: Yoshihito Gomi, Yamanashi-ken, Japan

[73] Assignee: Mitsui Kinzoku Kogyo Kabushiki Kaisha, Tokyo, Japan

[21] Appl. No.: 728,316

[22] Filed: Oct. 9, 1996

[30] Foreign Application Priority Data

Oct. 9, 1995 [JP] Japan ..... 7-288002

[51] Int. Cl.[6] ..... E05C 3/06

[52] U.S. Cl. ..... 292/216; 292/223; 292/DIG. 64; 403/119; 403/153

[58] Field of Search ..... 292/216, DIG. 38, 292/223, 196, DIG. 64, DIG. 53, DIG. 65, DIG. 27; 403/119, 153, 164, 326, 329, 161, 163

[56] References Cited

U.S. PATENT DOCUMENTS

| | | | |
|---|---|---|---|
| 2,793,388 | 5/1957 | Bartholomew | 403/161 X |
| 3,121,579 | 2/1964 | Di Salvo et al. | 292/DIG. 27 X |
| 3,923,329 | 12/1975 | Torii et al. . | |
| 4,073,170 | 2/1978 | Miyabayashi et al. | 292/216 X |
| 4,334,704 | 6/1982 | Yamada . | |
| 4,492,395 | 1/1985 | Yamada | 292/216 |
| 4,522,008 | 6/1985 | Zeigler | 403/163 X |
| 4,697,948 | 10/1987 | Fukuda | 403/163 X |
| 5,015,020 | 5/1991 | Mizuki | 292/216 |
| 5,046,341 | 9/1991 | Ogino et al. | 292/216 X |
| 5,250,001 | 10/1993 | Hansen | 403/163 X |
| 5,538,112 | 7/1996 | Last | 403/163 X |

FOREIGN PATENT DOCUMENTS

| | | | |
|---|---|---|---|
| 2054855 | 5/1972 | Germany | 403/164 |

*Primary Examiner*—Rodney M. Lindsey
*Attorney, Agent, or Firm*—Browdy and Neimark

[57] ABSTRACT

A child proof apparatus for a vehicle door latch device comprises a child lever adapted to be manually turned, an intermediate lever having an abutting end engageable with an open lever and an elongated slot, and a child link having a child pin slidably engaged in the elongated slot. The pin is integrally formed in the child link and has a first engaging means which is engaged in the slot by being turned by a right angle after the pin is inserted into the slot. The child link has a snap fastener portion integrally formed therewith which is rotatably engaged in a second hole of the child lever. The child lever has a shaft integrally formed therewith having a second engaging means which is engaged in the slot by being turned by a right angle after the shaft is inserted into the slot.

8 Claims, 4 Drawing Sheets

FIG. 6
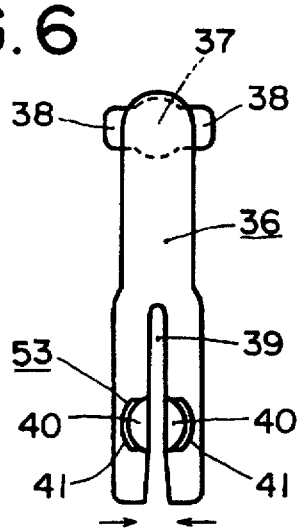
FIG. 7
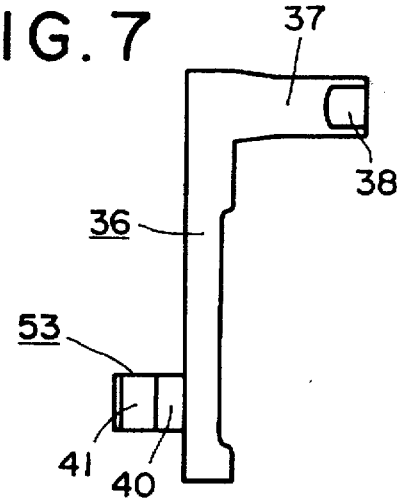
FIG. 8
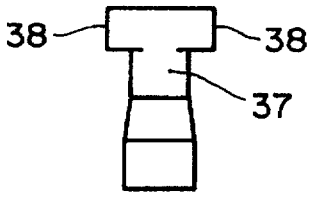
FIG. 9
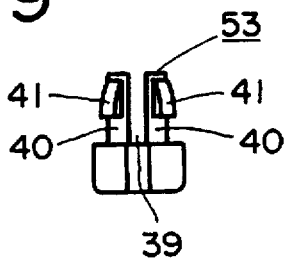
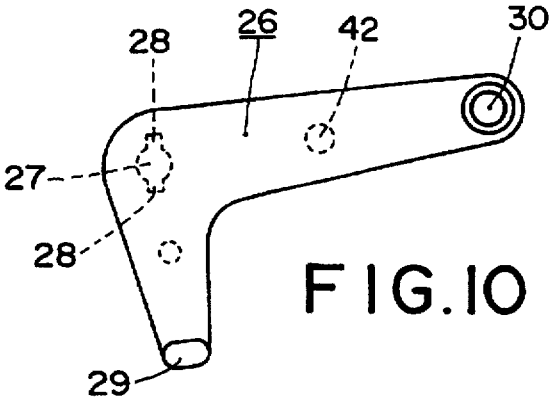
FIG. 10
FIG. 11
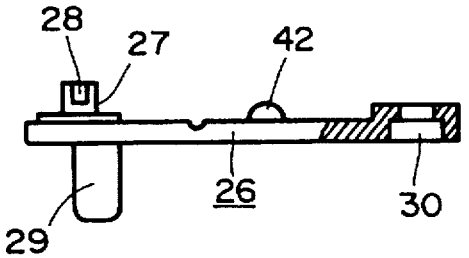
FIG. 12
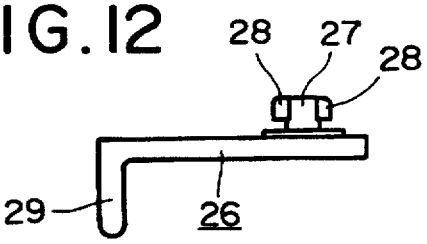
FIG. 13
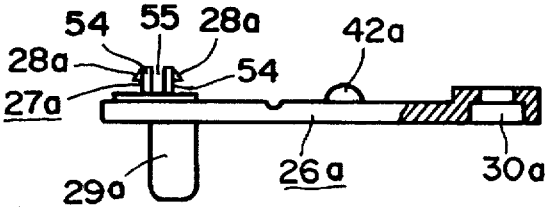

CHILD PROOF APPARATUS FOR VEHICLE DOOR LATCH DEVICE

BACKGROUND OF THE INVENTION

1. Field of the Invention

The present invention relates to a vehicle door latch device, and in particular to a child proof apparatus for a vehicle door latch device.

2. Prior Art

A prior art vehicle door latch device has a child proof apparatus which disables an unauthorized operation of an inside open handle of a door by a passenger such as a child.

U.S. Pat. No. 4,334,704 discloses a vehicle door latch device which comprises an open lever coupled to an outside open handle of a door for opening the door, a locking lever coupled to an inside lock button of the door and displaceable between a locked position for disabling an opening operation of the open lever and an unlocked position for enabling the opening operation of the open lever, an inner lever coupled to an inside open handle of the door, and a child proof mechanism provided between the the open lever and the inner lever and displaceable between a non-child proof condition for connecting the inner lever and the open lever and a child proof condition for disconnecting the inner lever and the open lever. The prior art child proof mechanism has, as shown in FIG. 1, an L-shaped child lever A having a manipulating knob, an intermediate lever D having an abutting end C engageable with an end portion B of the open lever, and a child link G displaceable between a child proof position and a non-child proof position by a displacement of the child lever A. The child link G has a T-head pin F slidably engaged in a slot E of the intermediate lever D and a T-head shaft J engaged in a hole H of the child lever A.

The prior art child proof mechanism has encountered difficulty in assembly. That is, since the child link G has two T-heads at both end thereof, the T-head shaft j is engaged in the hole H after the T-head pin F is engaged in the slot E, and then, the child lever A is attached to the a base plate L by means of a shaft K. This process, in particular, the fixing of the shaft K to the plate L is very difficult.

U.S. Pat. No. 3,923,329 also discloses a child proof mechanism which comprises an L-shaped child lever (42) having a manipulating knob, an intermediate lever (34) having an abutting end (37) engageable with an end portion of an open lever, and a child pin (41) slidably engaged in a slot of the intermediate lever and displaceable between a child proof position and a non-child proof position through turning of the child lever.

In the latter prior art child proof mechanism, since the child lever (42) can be solely fixed to the base plate by means of a shaft, the assembling process of the child proof mechanism is easier than that of the former child proof mechanism. However, a process of forming a retaining head at a base end of the child pin (41) is required when the pin is slidably engaged with the intermediate lever (34).

SUMMARY OF THE INVENTION

An object of the present invention is to provided a child proof mechanism which can be easily assembled.

BRIEF DESCRIPTION OF THE INVENTION

FIG. 6 is a front view of a child link;

FIG. 7 is a side view of the child link;

FIG. 8 is an enlarged view illustrating a T-head pin of the child link:

FIG. 9 is an enlarged view of a snap fastener portion of the child link:

FIG. 10 is a front view of a child lever;

FIG. 11 is a partly cross-sectioned plan view of the child lever;

FIG. 12 is a side view of the child lever; and

FIG. 13 is a view illustrating a second embodiment of the child lever.

DETAILED DESCRIPTION OF PREFERRED EMBODIMENTS

Figure 1:
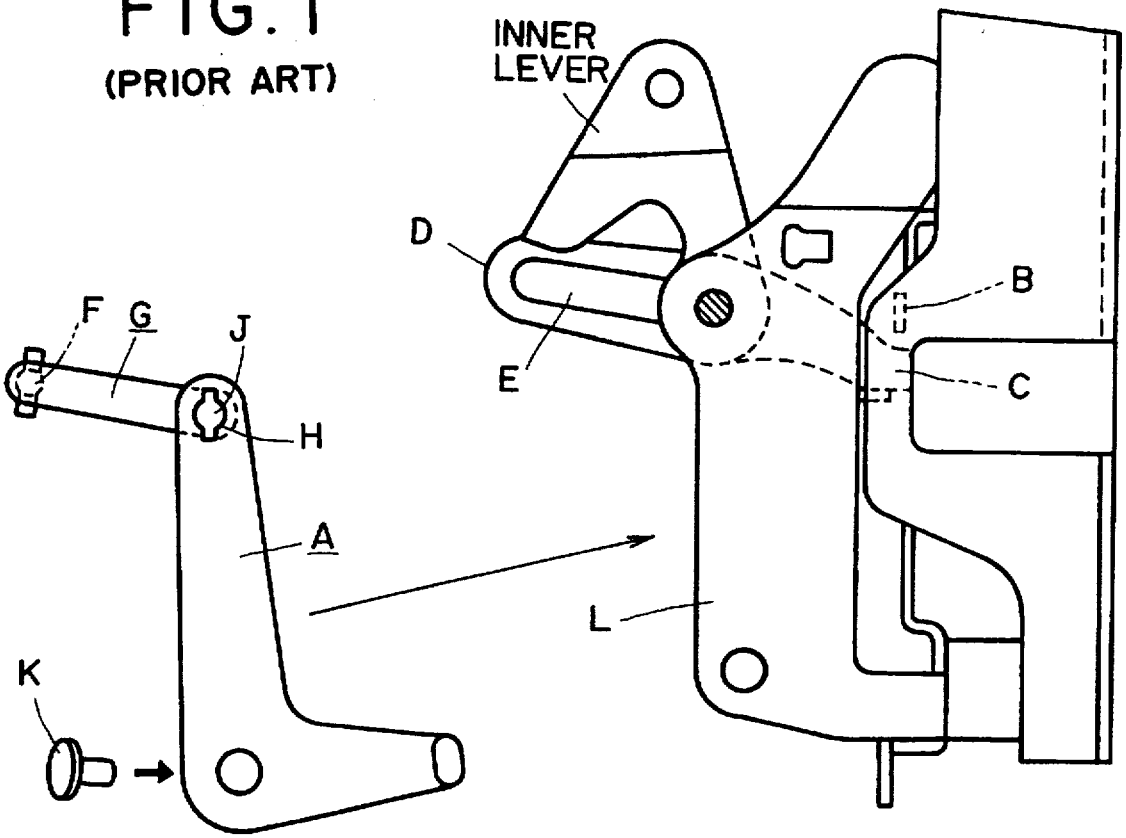
FIG. 1 (PRIOR ART)
FIG. 1 is a view illustrating an example of well-known apparatuses.
Figure 2:
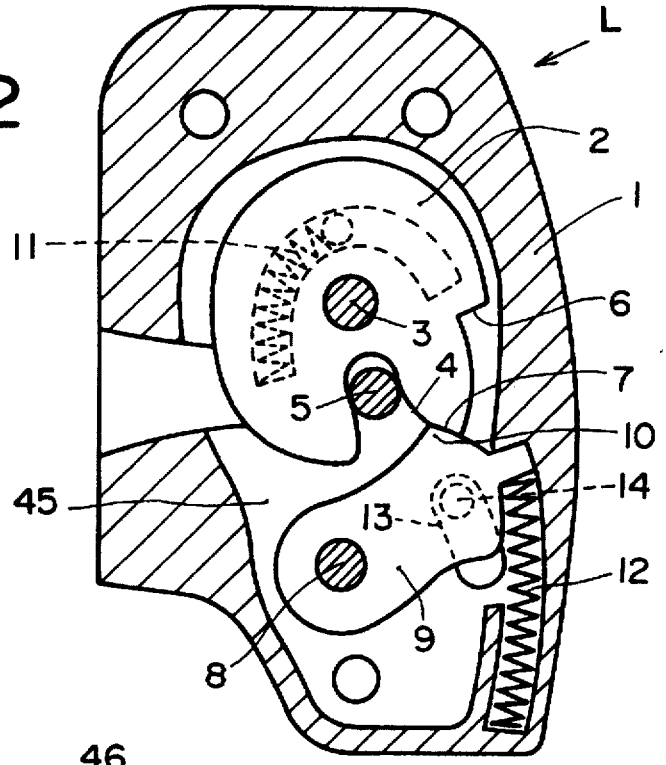
FIG. 2 is a longitudinally sectioned front view illustrating a latch body.

An embodiment of the present invention will now be described with. reference to the accompanied drawings. A door latch device L according to the present invention comprises a latch 2 adapted to be engaged with a striker 5 fixed to a vehicle body, and a ratchet 9 for maintaining the engagement between the latch 2 and the striker 5. The latch 2 and the ratchet 9 are rotatably attached in a recess 45 formed in a front side of a latch body 1 made of synthetic resin by a latch shaft 3 and a ratchet shaft 8, respectively. The latch 2 is urged by the resilient force of a spring 11 clockwise as viewed in FIG. 2, and the ratchet 9 is urged counterclockwise by the resilient force of a spring 12.

The latch 2 is turned counterclockwise against the resilient force of the spring 11 when the striker 5 is engaged in a fork part 4 of the latch 2, and the latch device L comes into a half-latched condition when a pawl 10 of the ratchet 9 is engaged with a half-latch step part 6 of the latch 2 while the latch device L falls in a full-latched condition when the pawl 10 is engaged with a full-latch step part 7 of the latch 2.

The ratchet 9 has a ratchet pin 14 which rearward projects through an opening 13 of the latch body 1. As the pin 14 is moved downward by an opening operation of a door opening mechanism described below, the ratchet 9 is separated from the latch 2 so as to open the door.

Figure 3:
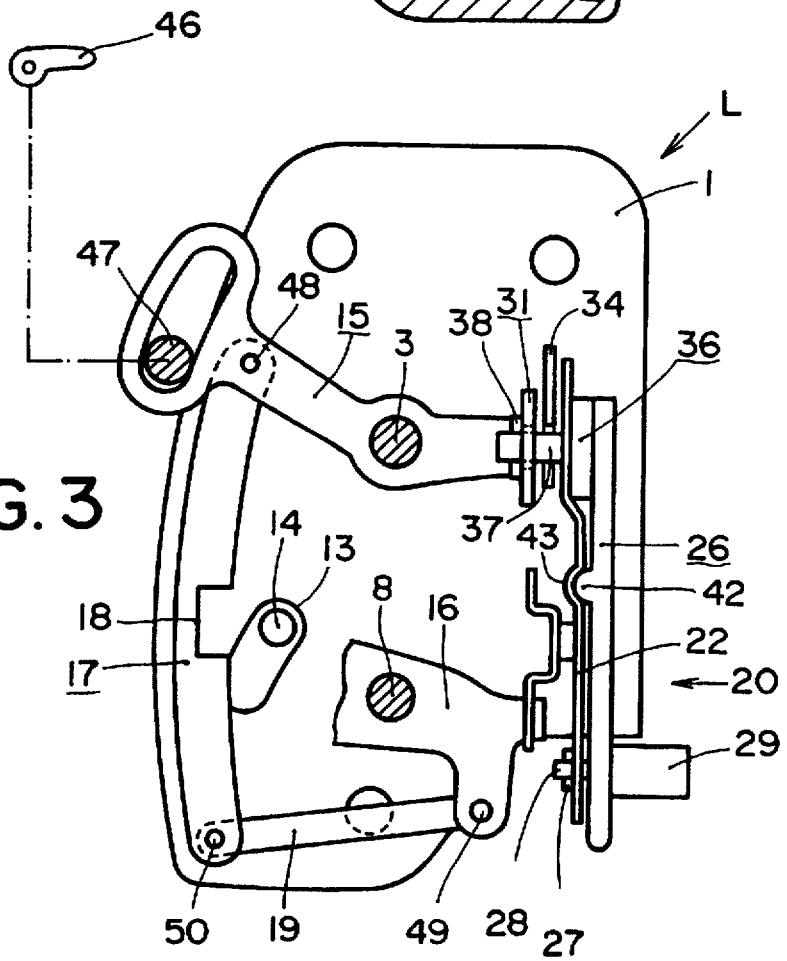
FIG. 3 is a rear view of a latch device.

FIG. 3 shows the door opening mechanism and a locking mechanism, both of which are provided on the rear side of the latch body 1. The door opening mechanism has an open lever 15 rotatably supported to the latch shaft 3 and coupled to an outside open handle 46 of a door through a rod 47, and an open link 17 coupled to the open lever 15 by a pin 48. The locking mechanism has a locking lever 16 rotatably supported to the ratchet shaft 8, and a coupling link 19 having one end coupled to the locking lever 16 by a pin 49 and the other end coupled to a lower end of the open link 17 by a pin 50.

The locking lever 16 is displaceable between a locked position (FIG. 3) and an unlocked position through the manipulation of an inside lock button 56 of the door. In the locked condition shown in FIG. 3, a recess 18 of the open link 17 is separated from the ratchet pin 14 of the ratchet 9, therefore, the ratchet 9 cannot be moved even though the open link 17 is moved downward through the manipulation of the open handle 46. The lower end of the open link 17 is moved rightward when the locking lever 16 is displaced to the unlocked position, thereby the recess 18 of the open link 17 is engaged with the ratchet pin 14. In this unlocked condition, when the open link 17 is moved downward, the pin 14 is also moved downward to release the ratchet 9 from the latch 2.

Figure 4:
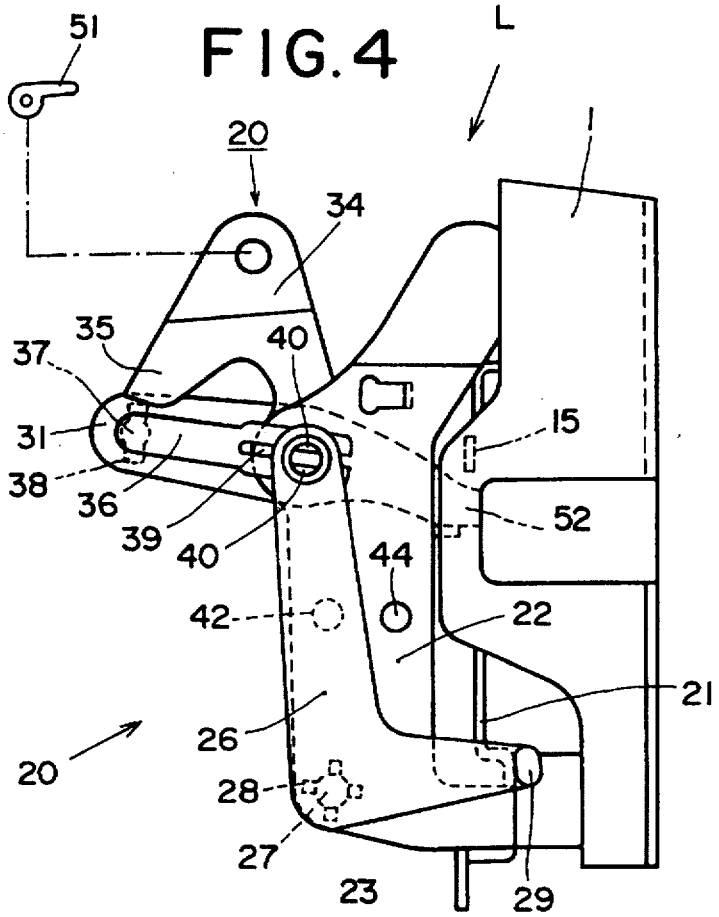
FIG. 4 is a side view of the latch device.
Figure 5:
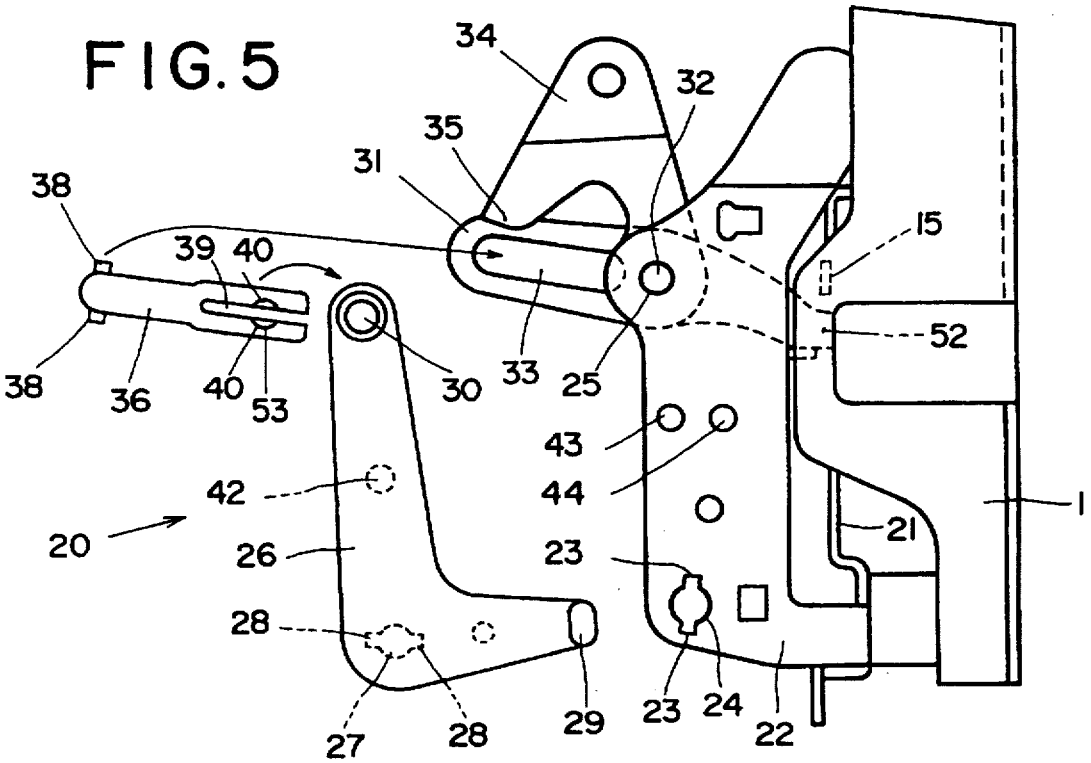
FIG. 5 is an exploded view illustrating a child proof mechanism.

On the rear side of the latch body 1, a metal back plate 21 is attached. A rearwardly projecting bent plate 22 is integrally formed on an interior side of the back plate 21. As shown in Fig. 4, a child proof mechanism 20 and an inner lever 34.coupled to an inside open handle 51 of the door are provided on the bent plate 22. The child proof mechanism 20 is displaceable between a non-child proof condition where a rotational force of the inner lever 34 is transmitted to the open lever 15 and a child proof condition where the rotational force of the inner lever 34 is not transmitted to the open lever 15. The child proof mechanism 20 is provided on the door latch device L used in a rear door.

The child proof mechanism 20 will be explained. The child proof mechanism 20 is composed of three components, that is, an L-shaped child lever 26 having a manipulating knob 29 at one end thereof, a child link 36 adapted to be displaced by a rotation of the child lever 26 between a child proof position and a non-child proof position, and an intermediate lever 31 having an abutting end 52 which is engageable with an end part of the open lever 15.

The child lever 26 which is made of synthetic resin has a T-head shaft 27 with a pair of radially extending protrusions 28 integrally formed with the child lever 26. After the T-head shaft 27 is inserted in an engaging hole 24, which has a pair of cut-out portions 23 corresponding to the protrusions 28, formed in the bent plate 22, it is turned by a right angle, thereby the protrusions 28 of the shaft 27 are caught in the engaging hole 24 so that it is prevented from coming off. Accordingly, the attachment of the child lever 26 is extremely simple.

The intermediate lever 31 is rotatably supported to a shaft 32 which is inserted into a shaft hole 25 of the bent plate 22. The intermediate lever 31 is preferably made of metal, and is formed therein with an elongated slot 33 extending radially of the shaft 32. The shaft 32 also rotatably carries thereon the inner lever 34.

The child link 36 is made of synthetic resin and is integrally provided at one end with a T-head pin 37 which has a pair of radially extending protrusions 38. When T-head pin 37 is turned by a right angle after it is inserted into the elongated slot 33 of the intermediate lever 31, the protrusions 28 are caught in the elongated slot 33 so that the T-head pin 37 is prevented from coming off.

The child link 36 is integrally provided at the other end with a snap fastener portion 53 which is pushed into a circular hole 30 formed in the other end of the child lever 26. The snap fastener 53 has two opposing portions 40 which are separated from each other by a slit 39. Each opposing portion 40 has an outward facing detent projection 41. When the opposing portions 40 are pushed into the circular hole 30, the detent projections 41 are engaged in the circular hole 30 due to the spring action of the slit 39.

The child lever 26 has a protrusion 42 adapted to be selectively engaged with either one of recesses 43, 44 formed in the bent plate 22. When the child lever 26 is swung around the shaft 27 in either direction by manipulation of the manipulating knob 29, the T-head pin 37 of the child link 36 slides along the elongated slot 33. In the non-child proof condition, as shown in FIG. 4, the pin 37 is located at an outer end of the elongated slot 33, and the snap fastener portion 53 of the child link 36 overlaps with the shaft 32. In this non-child proof condition, when the inner lever 34 is turned by the inside open handle 51, an abutting end 35 of the inner lever 33 comes into contact with the pin 37 so as to rotate the child link 36 and the intermediate lever 31. Then, the open lever 15 is turned by the engagement with the abutting portion 52 of the intermediate lever 31. Oppositely, when the T-head pin 37 of the child link 36 comes to an inner end of the elongated slot 33, the child proof mechanism 20 is changed over into the child proof condition. In this condition, since the pin 37 is separated from the abutting end 35 of the inner lever 34, the rotational force of the inner lever 34 is not transmitted to the open lever 15.

When assembling the above-mentioned child proof mechanism 20, the intermediate lever 31 is at first attached to the bent plate 22 by the shaft 32 together with the inner lever 34. The T-head pin 37 of the child link 36 is then inserted in the elongated slot 33 of the intermediate lever 31, and turned by a right angle so that the pin 37 is prevented from coming off from the elongated slot 33. Thereafter, the T-head shaft 27 of the child lever 26 is inserted in the engaging hole 24 of the bent plate 22, and turned by a right angle so that it is attached to the bent plate 22. Finally, the snap fastener portion 53 of the child link 36 is pushed into the circular hole 30 of the child lever 26. At this time, the opposing portions 40 of the snap fastener 53 are easily inserted in the circular hole 30 due to the spring action of the slit 36, and the projections 41 are resiliently engaged in the circular hole 30 so that the snap fastener 53 is prevented from coming off from the circular hole 30. Thus, according to the present invention, since the T-head pin 37 and the snap fastener 53 are integrally formed in the child link 36 and the T-head shaft 27 is integrally formed in the child lever 26, the child proof mechanism 20 can be assembled simply without use of any special working process.

FIG. 13 shows another embodiment of the child lever 26*a* which has a snap fastener shaft 27*a* instead of the T-head shaft 27. The snap fastener shaft 27*a* has two opposing portions 54 separated from each other by a slit 55, and each opposing portions 54 has a detent projection 28*a*. If this snap shaft 27*a* is used, the engaging hole 24 in the bent plate 22 is formed in a circular shape having no cut-out.

What is claimed is:

1. A child proof apparatus for a vehicle door latch device, comprising:

an open lever coupled to an outside open handle of a door for opening the door when turned;

a locking lever coupled to an inside lock button of the door and displaceable between a locked position for disabling an opening operation of the open lever and an unlocked position for enabling the opening operation of the open lever;

an inner lever coupled to an inside open handle of the door;

a child proof mechanism adapted to be attached to a stationary member of the latch device, said child proof mechanism being displaceable between a non-child proof condition where a rotational force of the inner lever is transmitted to the open lever and a child proof condition where the rotational force of the inner lever is not transmitted to the open lever, said child proof mechanism having a child lever adapted to be manually turned, an intermediate lever having an abutting end engageable with the open lever and an elongated slot, and a child link having a child pin slidably engage in the elongated slot;

said intermediate lever adapted to be rotatably supported to the stationary member by a first shaft;

said child pin being displaceable by the child lever between a non-child proof position where it is engageable with the inner lever and a child proof position where it is disengageable with the inner lever, said child pin being formed as a unit with one end of the child link, said child pin having a first T-headed engaging means which prevents the child pin from being disengaged from the intermediate lever by engaging in the elongated slot when the first T-headed engaging means, is turned by an about right angle after the child pin is inserted in the elongated slot; and said child lever rotatably journalled by a second shaft which is adapted to be inserted into a first hole formed in the stationary member, said child lever having a second hole;

wherein said child link has, at the other end, an integrally formed snap fastener portion which is rotatably engaged in the second hole;

wherein said second shaft is formed as a unit with the child lever, and has a second T-headed engaging means adapted to be engaged in the first hole;

wherein said second T-headed engaging means is engaged with the first hole by being turned by an about right angle after the second shaft is inserted in the first hole.

2. A child proof apparatus as set forth in claim 1, wherein said second engaging means has a pair of protrusions which project in opposite directions from a tip end of the second shaft.

3. A child proof apparatus as set forth in claim 1, wherein said second shaft is integrally formed on the child lever, said second shaft having a first slit, first opposing portions separated from each other by the first slit so as to be resiliently deformed, and a second engaging means formed in a tip end of each of the first opposing portions.

4. A child proof apparatus as set forth in claim 1, wherein said snap fastener portion has a second slit, second opposing portions separated from each other by the second slit so as to be resiliently deformed, and a third engaging means formed in a tip end of each of the second opposing portions.

5. A child proof apparatus as set forth in claim 4, wherein said second shaft is integrally formed in the child lever, said second shaft having a second engaging means for engaging in the first hole.

6. A child proof apparatus as set forth in claim 5, wherein said second engaging means is adapted to be engaged in said first hole by being turned by an about right angle after the second shaft is inserted into the first hole.

7. A child proof apparatus as set forth in claim 6, wherein said second engaging means has a pair of protrusions which project in opposite directions from a tip end of the second shaft.

8. A child proof apparatus as set forth in claim 4, wherein said second shaft is integrally formed in the child lever, said second shaft having a first slit, first opposing portions separated from each other by the first slit so as to be resiliently deformed, and a second engaging means formed in a tip end of each of the first opposing portions.

* * * * *